US005244122A

United States Patent [19]

Botts

[11] Patent Number: 5,244,122

[45] Date of Patent: Sep. 14, 1993

[54] MEDICINE DISPENSING BABY BOTTLE

[76] Inventor: Lynne M. Botts, 6725 Siebern Ave., Cincinnati, Ohio 45236

[21] Appl. No.: 806,740

[22] Filed: Dec. 12, 1991

[51] Int. Cl.[5] ..... B67D 5/00

[52] U.S. Cl. ..... 222/133; 215/11.1; 222/145; 222/158; 222/386; 222/490

[58] Field of Search ..... 222/129, 133, 145, 158, 222/386, 490; 215/6, 11.1, 11.4, 11.5, 11.6; 606/234, 235, 236

[56] References Cited

U.S. PATENT DOCUMENTS

| | | | |
|---|---|---|---|
| 2,680,441 | 6/1954 | Krammer | 215/11.1 X |
| 2,786,769 | 3/1957 | Greenspan | 215/11.1 X |
| 3,200,980 | 8/1965 | Jamell | 215/11.5 |
| 3,200,995 | 8/1965 | Gangwisch | 222/145 X |
| 3,741,383 | 6/1973 | Wittwer | 215/6 X |
| 4,821,895 | 4/1989 | Roskilly | 215/11.1 |
| 5,029,701 | 7/1991 | Roth et al. | 215/11.1 X |
| 5,078,734 | 1/1992 | Noble | 606/235 X |

FOREIGN PATENT DOCUMENTS

| | | |
|---|---|---|
| 1129858 | 1/1957 | France . |
| 1279226 | 6/1972 | United Kingdom . |

*Primary Examiner*—Andres Kashnikow
*Assistant Examiner*—J. A. Kaufman
*Attorney, Agent, or Firm*—Wood, Herron & Evans

[57] ABSTRACT

A medicine dispensing apparatus outwardly resembles a traditional nursing bottle assembly. The bottle has an internal but open ended receptacle to hold medicine, and the nipple has an integral tube to connect the receptacle to a nipple outlet hole to dispense the medicine. Simultaneous dispensing of the medicine along with the liquid inside the bottle is obtained. A syringe fits inside the receptacle and allows regulated dispensing of medicine.

12 Claims, 2 Drawing Sheets

MEDICINE DISPENSING BABY BOTTLE

FIELD OF THE INVENTION

This invention relates to dispensing medicine, and more particularly, to an improved apparatus for dispensing medicine to infants. The invention is also useful with non-infants where traditional modes of dispensing liquid medicine such as through a spoon or eyedropper are not effective.

BACKGROUND OF THE INVENTION

Dispensing medicine to an unwilling patient, more particularly to an infant, can be notoriously frustrating and oftentimes messy. The frustration occurs when the infant resists the administering of the medicine or refuses to ingest the medicine once administered. The mess results when the medicine is placed into the traditional utensils, such as a spoon or eyedropper, and when the unwilling infant spits the medicine from his mouth.

When an infant is still at the stage of being bottle fed, a spoon or eyedropper introduced into its mouth will be sensed as a foreign object, and subsequently, the infant often will seek to push the object away from or out of its mouth. Even if the infant has adjusted to a spoon or eyedropper, the unfamiliar taste of many medicines will still cause the infant to spit out the medicine once it has been administered. Furthermore, children's spoons and eye droppers are usually rigid, and in the case of a struggling infant, could possibly be dangerous to the baby's eyes, mouth or throat.

Along with the mess and frustration that comes from medicine which has been spilled or spit out by the infant, the more important question of proper dosage arises. With conventional methods, a certain amount of medicine may inherently be ingested before the infant refuses the remainder of the dosage. However, when the infant refuses a portion of the medicine, it becomes difficult to estimate or measure how much has been ingested, and therefore, how much medicine still needs to be given for a proper dosage. Not only is the obvious danger of later overdosage possible, there is also a risk of underdosage, making the medicine ineffective. An underdosage could be as significant as an overdosage if the medicine is critically needed by the infant.

Therefore, it is an object of this invention to provide an apparatus to introduce medicine to an infant in a way so as to reduce the likelihood of the infant rejecting the medicine. Towards this end, such an apparatus would preferably be of a form which is familiar to the baby and which an infant would eagerly desire to take into its mouth. It is further desirable to provide an apparatus which would allow the dosage of medicine to be precisely measured and dispensed. Finally, the apparatus would preferably be of a blunt, soft, non-harmful form to allow the safe introduction of medicine should the baby be moving its head rapidly or flailing its arms.

Several prior efforts have dealt with the problem of dispensing medicine to infants by utilizing a conventional baby bottle assembly and have resulted in issued patents, such as, Krammer U.S. Pat. No. 2,680,441, Greenspan U.S. Pat. No. 2,786,769, Roskilly U.S. Pat. No. 4,821,895 and Roth et al. U.S. Pat. No. 5,029,701. The devices of these prior patents have certain structural and functional disadvantages. The Krammer nursing bottle attachment includes an external syringe mounted on the side of the bottle. An infant can easily reach the syringe to dislodge it, spilling medicine and presenting a pointed object which may puncture the infant's face or mouth.

The Greenspan device is not intended for the dispensing of medicine. It includes only a center chamber for mixing a powdered formula with a liquid in the bottle. There is no way for medicine in the chamber to enter the infant's mouth other than through the mixture which may dilute sufficiently so as to make it ineffective.

The Roskilly device includes an awkward bottle lid attachment which has no separate discharge hole for the medicine and which has an accessible syringe which the infant can grab and dislodge thus spilling the medicine and reducing the dosage amount.

Finally, the Roth et al. device is merely a kit to attach a vial to conventionally sold nursing nipples and bottle assemblies. The kit dedicates the nipple to the medicinal contents of the vial and therefore does not solve the predominant problem of giving medicine to an infant, i.e., the unfamiliar taste and subsequent refusal by an infant to take the medicine.

Another object of this invention is to provide a medicine dispenser of minimal separate parts which may be lost or broken. The Krammer, Roskilly and Roth et al. devices utilize numerous separate pieces besides the conventional bottle and nipple. Consequently, the odds of losing or breaking one of the pieces of the assembly are increased which will render the complete assembly inoperable.

SUMMARY OF THE INVENTION

To these ends, a preferred embodiment of the invention includes a medicine dispensing apparatus having as its focus a traditional nursing bottle.

A nipple is secured to the top of the bottle. A receptacle is formed within the bottle body, and extends axially along its length from the bottom of the bottle towards the open mouth of the bottle. In a preferred embodiment, the receptacle bottom is integrally formed with the bottom of the bottle to seal the bottom of the bottle while simultaneously providing an accessible inlet port to the receptacle. The top end of the receptacle extends through the open mouth of the bottle.

The nipple of the present invention includes a tube which connects at one end at least to one of a plurality of openings in the discharge end of the nipple. The other end of the nipple tube is formed to engage the top end of the bottle receptacle. Therefore, when the nipple is secured to the bottle, the top end of the bottle receptacle is coupled to the corresponding bottom end of the nipple tube. This allows medicine from the receptacle to flow out the discharge end of the nipple, and into the mouth of the infant. In addition, the present invention has at least one other opening in the discharge end of the nipple which allows the contents of the bottle to flow out the end of the nipple simultaneous with dispensement of the medicine. In this way, a liquid desired by the infant, such as milk or juice, masks the unfamiliar taste of the medicine.

In one embodiment, the receptacle would have graduations therein to allow medicine to be dispensed in precise dosages to the infant. Thus, while the baby is nursing on the bottle, the precise amount of medicine ingested can be readily seen by examining the level of medicine in the graduated receptacle. To prevent the medicine from escaping out the open bottom end of the receptacle in this embodiment when the bottle is otherwise than inverted, a pliable, ventilated plug is inserted into the bottom of the bottle to seal the receptacle.

In an alternative embodiment of the invention a syringe assembly, comprising a syringe barrel and a plunger, can be inserted through the receptacle bottom to measure and dispense the medicine and to control the flow of medicine to the infant. To use the syringe, the ventilated plug is removed. The syringe is shaped to fit somewhat snugly within the receptacle when inserted and the top of the syringe barrel fits into the top of the receptacle securely to allow the medicine to be injected into the nipple tube without back spillage into the open receptacle. An O-ring on the outer barrel surface of the syringe can seal it in place in the receptacle, preventing any back flow around the syringe.

Since the medicine receptacle in the preferred embodiment is integrally formed within the bottle as part of the bottle body, it can be washed along with the bottle as a single unit. Therefore, it is not subject to be misplaced and is less likely to be damaged when the assembly is disassembled and washed. Similarly, the tube in the nipple of a preferred embodiment of the present invention is also preferably formed integrally with the nipple, and therefore, it also is washed as a single unit with the nipple and is less likely to be misplaced or damaged.

The traditional nursing bottle used to dispense medicine provides an infant with a form that he is familiar with, and hence immediately reduces the risk of the child moving its head and mouth away from the medicine dispenser or subsequently spitting the medicine out. The present invention allows dispensing of medicine while at the same time allowing a flow of milk or another liquid desired by an infant from the bottle which will act to mask the foreign taste of the medicine, and therefore, further increase the odds that the child will ingest the medicine without spitting it out.

These advantages and others will become readily apparent from the following detailed description of the preferred embodiment and from the drawings in which:

BRIEF DESCRIPTION OF THE DRAWINGS

FIG. 4 is an end view of the rear end of the nipple, taken along lines 4—4 of FIG. 3.

DETAILED DESCRIPTION OF THE INVENTION

Figure 1:
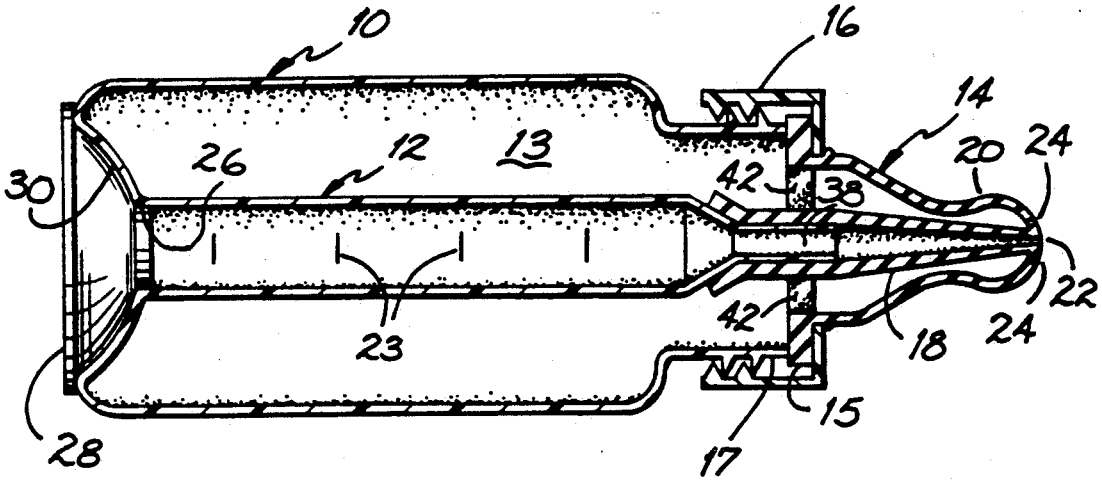
FIG. 1 is a cross-sectional view of the present invention without the syringe attachment.

Turning now to the drawings, there is shown in FIG. 1 an apparatus for dispensing medicine according to the present invention. The apparatus is outwardly similar to a conventional nursing bottle assembly and includes a bottle 10 and a receptacle 12 within and extending axially along the length of bottle 10. The receptacle 12 is smaller than the inside dimensions of bottle 10 so that a fluid reservoir 13 is formed inside bottle 10, between the receptacle 12 and the interior walls of bottle 10. Receptacle 12 is fluidly isolated from and substantially surrounds the inside reservoir 13 of the bottle.

A nipple 14 has an integral annular gasket 15. A securing ring 16 screws onto the threaded mouth 17 of bottle 10 holding nipple 14, via gasket 15, securely in place to seal the bottle.

A tube 18 extends inside nipple 14 from the discharge end 20 of the nipple back towards the mouth of the bottle. One end of tube 18 is connected to an opening 22 in the discharge end 20 of the nipple. The other end of the tube 18 is formed to receive the top or first end of receptacle 12. Therefore, when nipple 14 is secured to bottle 10, liquid can pass from receptacle 12 to tube 18 without escaping into the liquid contents of reservoir 13 of the bottle. In this way, when the bottle is inverted, medicine flows from receptacle 12, through tube 18, and out opening 22 into the mouth of the nursing infant. In one embodiment of the invention, receptacle 12 has graduations 23 thereon for measuring the exact amount of medicine administered to the infant.

Since bottle 10 is also operative as a traditional nursing bottle, and reservoir 13 is fluidly isolated from medicine receptacle 12, the bottle can be utilized to hold other liquids such as milk or juice to be dispensed simultaneously with the medicine. To this end, nipple 14 contains at least one other opening 24 which communicates with reservoir 13 instead of receptacle 12. Opening 24 allows the contents of reservoir 13 in bottle 10 to flow out discharge end 20 of the nipple simultaneous to the dispensing of medicine from receptacle 12 through opening 22. Such a feature is advantageous in that it allows the liquid medicine to mix with another liquid which the infant is accustomed to ingesting, such as milk or juice. This other liquid acts to mask the taste of the medicine which the baby may find unfamiliar and thus undesirable.

The present invention can also be used with only medicine in receptacle 12, without milk or juice in the bottle or with only milk or juice and no medicine. Although the baby will taste the medicine when no milk or juice is used, the familiarity of a nursing nipple may be sufficient to induce the baby to ingest the medicine as opposed to spitting it out.

Referring to FIG. 1, receptacle 12 is formed to have an open end 26 at the bottom of the bottle 10. Medicine can be poured through end 26, or injected by a syringe, into the receptacle. When bottle 10 is in a position other than inverted, however, the medicine will tend to run out the bottom of receptacle 12. To prevent this, the present invention utilizes a ventilated plug 28 of rubber, soft plastic or a similar, pliable material which is inserted into the bottle bottom to seal the open bottom 26 of receptacle 12. In the preferred embodiment of the invention as shown in FIGS. 2 and 3, the bottom of bottle 10 is formed to have a concave recessed area 30 to allow a convex shaped plug 28 to be mounted substantially flush against the bottle bottom.

Figure 2:
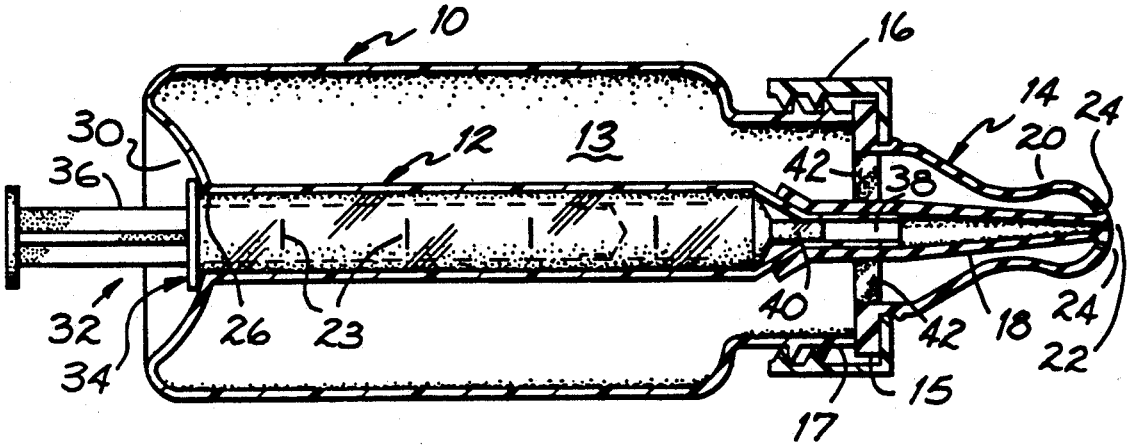
FIG. 2 is a cross-sectional view of the present invention with the syringe attachment.
Figure 3:
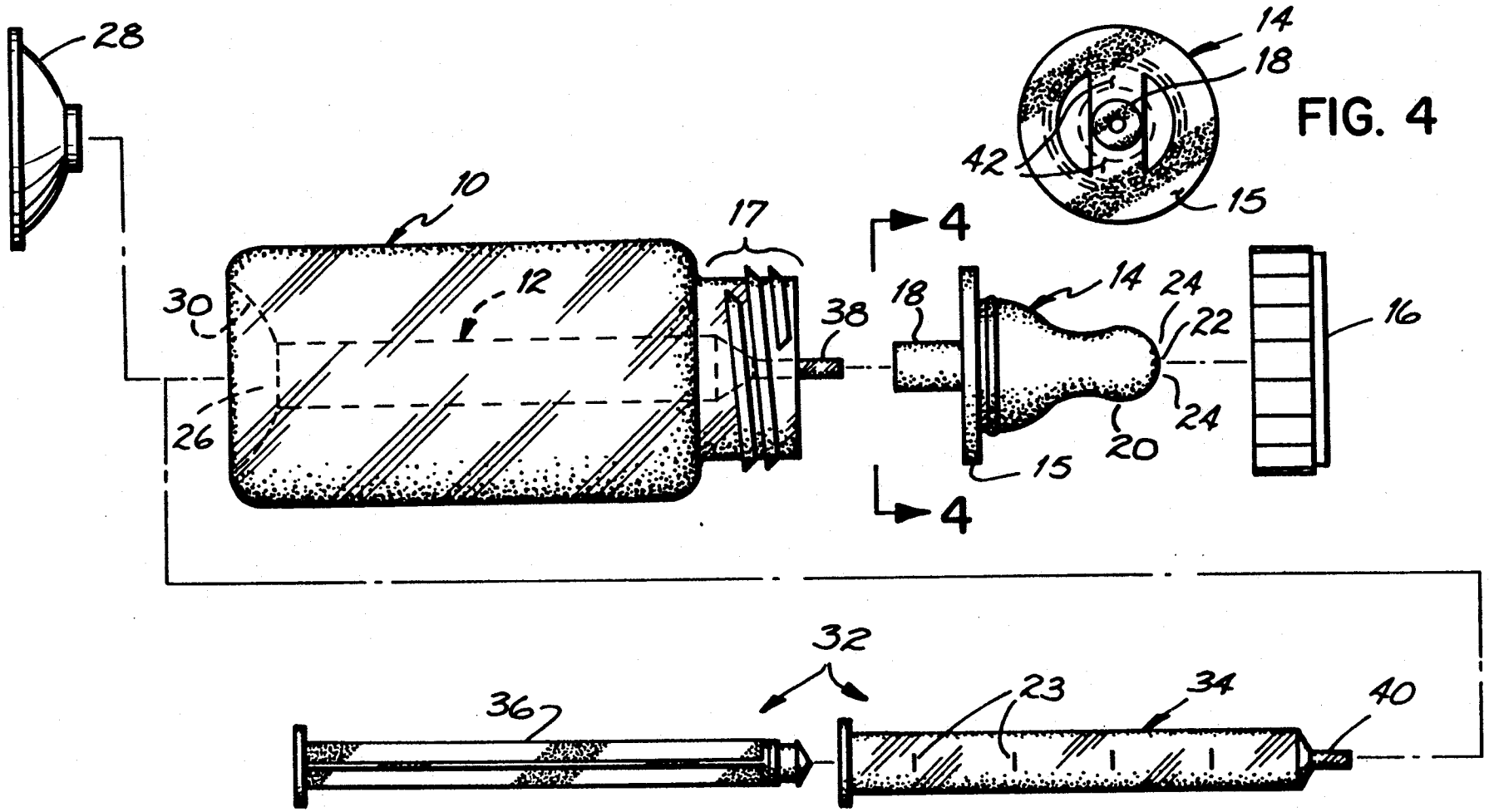
FIG. 3 is an exploded view showing the individual elements of the present invention.

In another embodiment of the invention, referring to FIG. 2, a syringe assembly 32 can be used to dispense the medicine into nipple 14. As shown in FIG. 2, a graduated syringe barrel 34 and a plunger 36 can be inserted into receptacle 12 to introduce medicine to the infant in a precise amount and at a controlled rate of flow. To insert syringe assembly 32, ventilated plug 28 is removed and syringe barrel 34 is simply inserted into receptacle 12. Preferably, the shape and dimensions of barrel 34 and receptacle 12 will be comparable so that the syringe assembly 32 can be left in the bottle without further securing means. It will also be appreciated that the syringe 32 can be used to measure medicine injected or introduced by the syringe into the receptacle 12.

One way of accomplishing the securement of syringe assembly 32 inside receptacle 12 as shown in FIG. 2 is to have a cylindrical receptacle 12 with an upper end 38 of smaller inside diameter than the outside diameter of the upper end 40 of syringe barrel 34. In this way, a snug fit between the receptacle end 38 and barrel end 40 will insure that the liquid is sufficiently transferred from barrel 34 to nipple channel 18 without any spillage back into the receptacle 12. In addition, a barrel 34 of a diameter sufficient to fit snugly within the receptacle 12 will ensure further securement of the syringe assembly 32 inside receptacle 12. Of course, an O-ring seal could be used around the syringe barrel, sealing it against the inner wall of the receptacle. Adequate securement of syringe assembly 32 further prevents medicine spillage from taking place when the bottle is thrown or dropped as tends to happen.

In a preferred embodiment of the present invention, receptacle 12 is formed as an integral part of bottle 10, i.e., a one-piece bottle unit. As illustrated in FIG. 3, receptacle 12 has an inlet 26 into the medicine receptacle and the bottle 10 has a closed bottom to allow the bottle to hold a liquid while leaving receptacle 12 open rearwardly for the receipt of medicine. Preferably, bottle 10 and receptacle 12 are molded together so as to define the bottle bottom and receptacle inlet 26 in one continuous surface. However, other ways of mounting the receptacle 12 inside bottle 10 such as screwing a receptacle into a threaded bottle bottom, could be used. A bottle having an integral receptacle 12, as shown in the present invention, also presents a single bottle unit for washing and eliminates the possibility of losing or separately damaging the receptacle when the apparatus is disassembled for washing.

Similarly, in a preferred embodiment of the present invention, tube 18 of nipple 14 is integrally formed within nipple 14 so that the nipple and tube also are a one piece unit.

Referring to FIGS. 1 and 2, annular gasket ring 15 aids in sealing the bottle top when the nipple 14 is secured. Preferably, tube 18 is formed to extend axially within nipple 14 with one end connected to opening 22. Referring to FIG. 4, a bridge portion 42 is attached to the tube and to the inside of annular ring 15 for holding tube 18 axially centered within nipple 14. The bridge portion 42 spans across the inside of nipple 14 and suspends tube 18 within nipple 14. Since the bridge portion 42 does not cover the entire bottom end of the nipple, fluid from reservoir 13 of bottle 10 can flow into the nipple and exit through opening 24 to mix in the infant's mouth with the medicine being dispensed through opening 22. Having the tube 18 integral with the nipple 14 allows the nipple to also be washed as a single unit thus eliminating the danger of losing the tube were it a separate piece.

As such, the present invention discloses a medicine dispensing apparatus which will result in more successful and more accurate dispensing of medicines to infants while at the same time preventing the mess often associated with trying to feed an infant an unfamiliar tasting medicine from an unfamiliar utensil. In addition, the integral structure of both the receptacle within the bottle and the tube within the nipple allows for easy washing of the pieces of the invention without worry about loss or difficult assembly later on. Finally, the soft rubber nipple on the end of the bottle will not injure an infant's eyes, mouth or skin.

It will also be appreciated that use of the syringe will further enhance full consumption of the medicine. Specifically, the syringe will be held passive until sucking by the baby on the milk or juice in the bottle is established. Then the syringe is operated slowly to inject the medicine into the receptacle, medicine tube and nipple and into the baby's mouth while sucking of milk and juice continues.

From the above disclosure of the general principles of the present invention and the preceding detailed description of a preferred embodiment, those skilled in the art will readily comprehend the various modifications to which the present invention is susceptible without departing from the scope thereof. Therefore, I desire to be limited only by the scope of the following claims and equivalents thereof.

I claim:

1. A liquid and medicine dispensing apparatus for infants comprising:

a bottle having an open end, a nipple mounted on the open end of said bottle, said nipple having at least two discharge holes, a medicine tube disposed within said nipple and connected to one of said holes, a medicine receptacle disposed within said bottle and removably connected to said tube for dispensing medicine through said one hole, said receptacle being smaller than the inside dimension of said bottle to define a liquid reservoir in said bottle for receiving a liquid, said other discharge hole operably communicating with said liquid reservoir; and said nipple permitting said liquid and medicine to be dispensed into an infant's mouth simultaneously.

2. The dispensing apparatus of claim 1, the medicine tube is integral with the nipple.

3. The dispensing apparatus of claim 1 wherein the receptacle is integral with the bottle.

4. The dispensing apparatus of claim 1 wherein the bottle has a closed bottom defining an inlet port in the receptacle, further comprising a ventilated plug fitting into the bottom of the bottle for sealing the inlet port of the receptacle to contain the contents of the receptacle.

5. The dispensing apparatus of claim 1, the receptacle including graduations thereon for measuring the quantity of liquid to be dispensed from the receptacle.

6. The dispensing apparatus of claim 1 further comprising a syringe assembly comprising a syringe barrel and a plunger slidably mounted inside the barrel, said syringe barrel being formed to fit within the receptacle for dispensing a substance from the syringe barrel into the nipple tube and out said tube discharge hole.

7. The dispensing apparatus of claim 6 wherein the receptacle and syringe barrel are both cylindrical, said receptacle further having one end of smaller inner diameter than the outer diameter of one end of said syringe barrel to allow said barrel end to fit securely inside the receptacle end when the syringe assembly is placed inside the receptacle.

8. A liquid and medicine dispenser for infants comprising:

a bottle having a bottom end and an open top end;

a medicine syringe including a barrel member and a plunger;

a syringe receptacle disposed within said bottle and having bottom and top ends, said receptacle extending inside said bottle from the bottom of the bottle towards the open bottle top, the bottom end of said receptacle defining a port in the bottle bottom and said bottle bottom being otherwise closed while leaving the receptacle bottom end open at said port to receive said medicine syringe within said receptacle, a nipple having at least two discharge holes, a medicine tube integrally formed within said nipple and integrally connected at one end to one of said holes, said tube formed at another end to receive the top end of said receptacle for dispensing medicine from said syringe through said one hole, said receptacle being smaller than the inside dimension of said bottle such that a liquid reservoir is formed within said bottle outside said receptacle, said other discharge hole operably communicating with said liquid reservoir; and securing means for securing said nipple to the open end of the bottle, whereby when the nipple is secured to the bottle, the medicine tube operably connects with the receptacle, and medicine can be dispensed from said syringe through one of said discharge holes in said nipple simultaneously with dispensing of said liquid through another of said discharge holes from said reservoir into the infant's mouth.

9. The dispenser of claim 8 wherein said syringe is removably from said receptacle for introduction of liquid into said receptacle and further comprising a ventilated plug fitting into the bottom of the bottle for sealing the open port in the bottom end of the receptacle to contain the liquid contents of the receptacle.

10. A medicine dispenser for simultaneously dispensing medicine and a separate liquid to infants, and comprising:

a bottle, a receptacle within the bottle;

an opening in the bottom of the bottle into the receptacle;

a medicine syringe disposed in said receptacle, said receptacle having a forward end;

a nipple for operable connection to said bottle and having at least two discharge openings, a first opening for passing medicine from said receptacle to an infant and a second opening communicating with the interior of said bottle outside said receptacle for passing liquid therein to an infant separately from but simultaneously with said medicine;

a tube integral with said nipple communicating with said first opening and extending rearwardly to the forward end of said receptacle;

said tube operably connected to said receptacle; and said syringe having a forward end sealed to said receptacle such that medicine expressed from said syringe enters said tube and is dispensed to an infant through said first discharge opening independently from said liquid but simultaneously therewith.

11. A dispenser for dispensing medicine and a liquid simultaneously through a nipple means to an infant, said dispenser comprising:

a bottle having an outer wall a closed bottom and an open top end for receiving a nipple means;

an inner medicine receptacle extending inside the bottle outer wall from said closed bottom toward said open top end;

a syringe;

a port in the bottle bottom defining an opening in the receptacle for introducing said syringe into the receptacle;

said receptacle being disposed within said bottle;

a liquid reservoir defined within said bottle outside said receptacle; and one end of said receptacle having means for operably connecting said receptacle with a nipple means to dispense the medicine from the syringe to an infant free of any liquid within said reservoir prior to discharge;

whereby when the bottle is connected with nipple means, medicine and a liquid can be dispensed to an infant simultaneously through the nipple means.

12. In combination, a baby bottle, medicine dispenser and nipple for use in dispensing medicine and a liquid simultaneously into an infant's mouth, and comprising:

a bottle having an opening;

a nipple adapted to be connected to said opening;

at least two discharge holes in said nipple;

a medicine dispenser within said bottle;

a medicine tube disposed within said nipple, one end of said tube connected to one of the discharge holes, the other end releasably connected to said medicine dispenser within said bottle; and said other discharge hole in said nipple operably communicating with an interior of said nipple outside said tube and said dispenser;

whereby separate medicine and liquid can be dispensed from said nipple through respective ones of said two discharge holes simultaneously.

* * * * *

UNITED STATES PATENT AND TRADEMARK OFFICE

CERTIFICATE OF CORRECTION

PATENT NO. : 5,244,122

DATED : September 14, 1993

INVENTOR(S) : Lynne M. Botts

It is certified that error appears in the above-identified patent and that said Letters Patent is hereby corrected as shown below:

In column 4, line 48 "after FIGS." and before "2", insert --1,--.

In column 7, line 24, "removably" should be --removable--.

Signed and Sealed this

Twenty-eighth Day of June, 1994

*Attest:*

Bruce Lehman

BRUCE LEHMAN

*Attesting Officer*

*Commissioner of Patents and Trademarks*